US005235389A

United States Patent [19]

Kikuchi et al.

[11] Patent Number: 5,235,389

[45] Date of Patent: Aug. 10, 1993

[54] REPLACEABLE TONER CARTRIDGE WITH INTERNAL STIRRING MEMBER, AND ELECTROPHOTOGRAPHIC PRINTER EMPLOYING THE SAME

[75] Inventors: Hiroshi Kikuchi; Yukio Ota; Yoshitomo Koga; Kazuki Obara; Yoshiharu Momiyama; Shigeki Nakajima; Kiyoshi Matsuda; Hisao Ono, all of Tokyo, Japan

[73] Assignee: Oki Electric Industry Co., Ltd., Tokyo, Japan

[21] Appl. No.: 777,329

[22] PCT Filed: Apr. 3, 1991

[86] PCT No.: PCT/JP91/00443

§ 371 Date: Nov. 29, 1991

§ 102(e) Date: Nov. 29, 1991

[87] PCT Pub. No.: WO91/15812

PCT Pub. Date: Oct. 17, 1991

[30] Foreign Application Priority Data

Apr. 6, 1990 [JP] Japan ..... 2-90176

[51] Int. Cl.[5] ..... G03G 15/06

[52] U.S. Cl. ..... 355/260; 222/DIG. 1

[58] Field of Search ..... 355/200, 210, 245, 260; 222/DIG. 1, 325, 564; 118/653

[56] References Cited

U.S. PATENT DOCUMENTS

| | | | |
|---|---|---|---|
| 4,641,945 | 2/1987 | Ikesue et al. | 222/DIG. 1 X |
| 4,696,418 | 9/1987 | Kurotaka et al. | 222/DIG. 1 X |
| 4,739,907 | 4/1988 | Gallant | 222/DIG. 1 X |
| 4,986,450 | 1/1991 | Yasuda et al. | 222/DIG. 1 X |
| 5,078,303 | 1/1992 | Kikuchi et al. | 355/260 X |

FOREIGN PATENT DOCUMENTS

| | | | |
|---|---|---|---|
| 49-1779 | 1/1974 | Japan . | |
| 49-8680 | 1/1974 | Japan . | |
| 0184968 | 10/1983 | Japan | 355/260 |
| 0086382 | 4/1987 | Japan | 355/260 |
| 62-170992 | 7/1987 | Japan . | |
| 63-2959 | 1/1988 | Japan . | |
| 63-47356 | 3/1988 | Japan . | |
| 0244079 | 10/1988 | Japan | 355/260 |

*Primary Examiner*—A. T. Grimley
*Assistant Examiner*—William J. Royer
*Attorney, Agent, or Firm*—Spencer, Frank & Schneider

[57] ABSTRACT

A toner cartridge employed in an electrophotographic printer and capable of attachment to or detachment from the electrophotographic printer. The toner cartridge includes a stirring member (4) which touches the inner wall of the cartridge (100) to reliably stir the toner contained in the cartridge (100). The stirring member (4) is rotatable and is interlocked with a gear (5) which is rotated by an external drive force.

8 Claims, 7 Drawing Sheets

REPLACEABLE TONER CARTRIDGE WITH INTERNAL STIRRING MEMBER, AND ELECTROPHOTOGRAPHIC PRINTER EMPLOYING THE SAME

BACKGROUND OF THE INVENTION

The present invention relates to a toner cartridge and an electrophotographic printer employing the same.

A conventional electrophotographic printer is discussed in Japanese Utility Model Laid-Open Publication No. 1-97356.

This electrophotographic printer has a rotatable cylindrical stirring means in a hopper for containing developer therein (hereinafter referred to as a developer hopper) to prevent the so-called toner blocking phenomenon from occurring inside the developer hopper. The toner blocking phenomenon means that a mass or clump of toner is formed inside the developer hopper. A developer supply roller, which is driven by an external device, is provided at the portion adjacent to the lower end of the developer hopper. The stirring means contacts the developer supply roller so that it is driven by the developer supply roller.

However, this electrophotographic printer has a problem in that the effect involving in stirring the toner is relatively remarkably reduced when the developer hopper is formed as a cartridge.

An electrophotographic printer having a detachable toner container as the developer hopper has been developed. The so-called toner cartridge can be replaced with another toner cartridge in order to facilitate the supply of the toner or prevent the toner from scattering on other portions of the electrophotographic printer, such as the paper feed system, when the toner is supplied into the electrophotographic printer.

Replaceable toner cartridges are now sold for use in photographic printers of this type. Since the toner cartridge of this type is filled with toner at the factory when the electrophotographic printer is manufactured, it cannot be touched by user's hands in ordinary circumstances.

Accordingly, it was a serious problem that the toner cartridge, which is liable to be kept in a warehouse for a long time, is likely to suffer from toner blocking.

This toner blocking is liable to be caused by a mass of toner which forms in the toner cartridge during storage in the warehouse and which sticks to the inner wall of the toner cartridge, or all of the toner may simply form a large mass. If toner blocking occurs, the resistance of the mass of toner to the stirring means is generally remarkably increased. In particular, if the mass of toner adheres to the stirring means, it sometimes happens that the stirring means can not rotate even if it contacts the supply roller. If the stirring means does not rotate, the toner is not stirred, which causes anomalous abrasion of the developer.

There is another problem in that the user cannot take out the mass of the toner after inspecting the inside of the cartridge every time the cartridge is replaced with another one. Furthermore the frequency of the replacement increases if the amount of the toner in a toner cartridge is decreased to prevent toner blocking from occurring which causes an increase in the printing cost.

SUMMARY OF THE INVENTION

It is therefore an object of the present invention to solve the problem set forth above and to provide a toner cartridge which is excellent in reliability and which capable of stirring the toner with assurance.

It is another object of the present invention to provide an electrophotographic printer capable of mounting the toner cartridge thereon without spoiling the handiness of the cartridge.

The toner cartridge includes a cylindrical container wherein the toner is stored and a stirring means rotatably provided in the container so as to touch substantially the entire surface of the inner wall of the container, making it is possible to prevent the toner from sticking to the inner wall and to stir all the toner with assurance. Accordingly, it is possible to provide a stable supply of the toner and print uniformly with high accuracy. It is possible to drive the stirring means by a drive means provided in the electrophotographic printer, whereby the stirring means can be driven even in a heavy load is applied to it by a mass of toner, since the driven means for the stirring means is provided outside the toner cartridge.

Furthermore, it is possible to couple the stirring means to the drive means using a drive force transmission means without obstructing the installation or removal of the toner cartridge from the electrophotographic printer.

Additionally, it is possible to employ a drive force transmission means with a reduction gear mechanism having a small diameter and large reduction gear ratio. As a result, the drive means can be made small, or a single drive means can serve as the drive unit for several parts in common, such as photosensitive drum and so forth. The reduction gear mechanism is composed of two gears having the same axis of rotation and substantially the same diameter and a gear meshing with both of these gears, which involves a reduction in the cost of the parts and the consumption of power.

DESCRIPTION OF THE PREFERRED EMBODIMENT

An electrophotographic printer according to an embodiment of the present invention will be described below with reference to the drawings.

Figure 1:
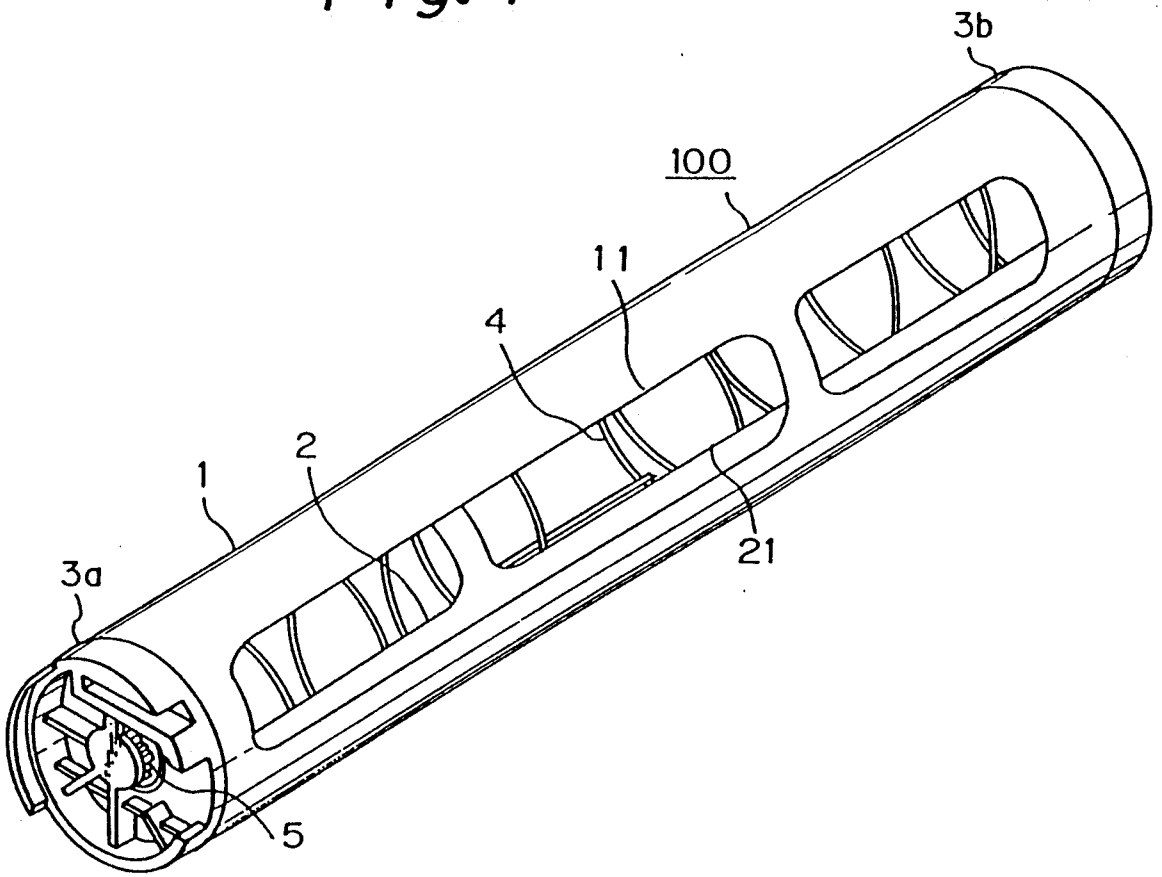
FIG. 1 is a perspective view showing the external appearance of a replaceable toner cartridge according to the present invention.

FIG. 1 is a perspective view showing the external appearance of a replaceable toner storing container (hereinafter refereed to as a toner cartridge) according to an embodiment of the present invention. In the same figure, designated at 1 is an outer cylinder, 2 is an inner cylinder, 3*a* and 3*b* are end plates, 4 is a stirring member and 5 is a gear. The outer cylinder 1 and the inner cylinder 2 are respectively thin hollow cylindrical members. The outer and inner cylinders 1 and 2 have substantially the same length and the inner cylinder 2 contacts the inner wall of the outer cylinder 1 along the entire length thereof.

Both ends of the inner cylinder 2 are closed by the end plates 3*a* and 3*b* which are fixed thereto. The end plates 3*a* and 3*b* have substantially the same diameter as that of the outer cylinder 1. With such an arrangement, the outer cylinder 1 can rotate relative to the inner cylinder 2 and does not get out of position relative to the inner cylinder 2 since the movement of outer cylinder 1 is restricted by the end plate 3*a* and 3*b* in the longitudinal direction thereof. The outer cylinder 1 and the inner cylinder 2 have respectively openings 11 and 21 at the side surfaces thereof as shown in FIG. 1. Accordingly, it is possible to open or close the openings by relative rotations between the outer cylinder 1 and the inner cylinder 2.

The stirring member 4 is inserted inside the inner cylinder 2. The stirring member 4 includes a basically filamentary member, e.g. a piano wire which is spirally formed and connected integrally with the gear 5 by an end member 41. The stirring member 4 is supported by the inner cylinder 2. When the gear 5 is rotated, the stirring member 4 rotates inside the inner cylinder 2 to form a surface of revolution touching internally the inner cylinder 2.

Figure 2:
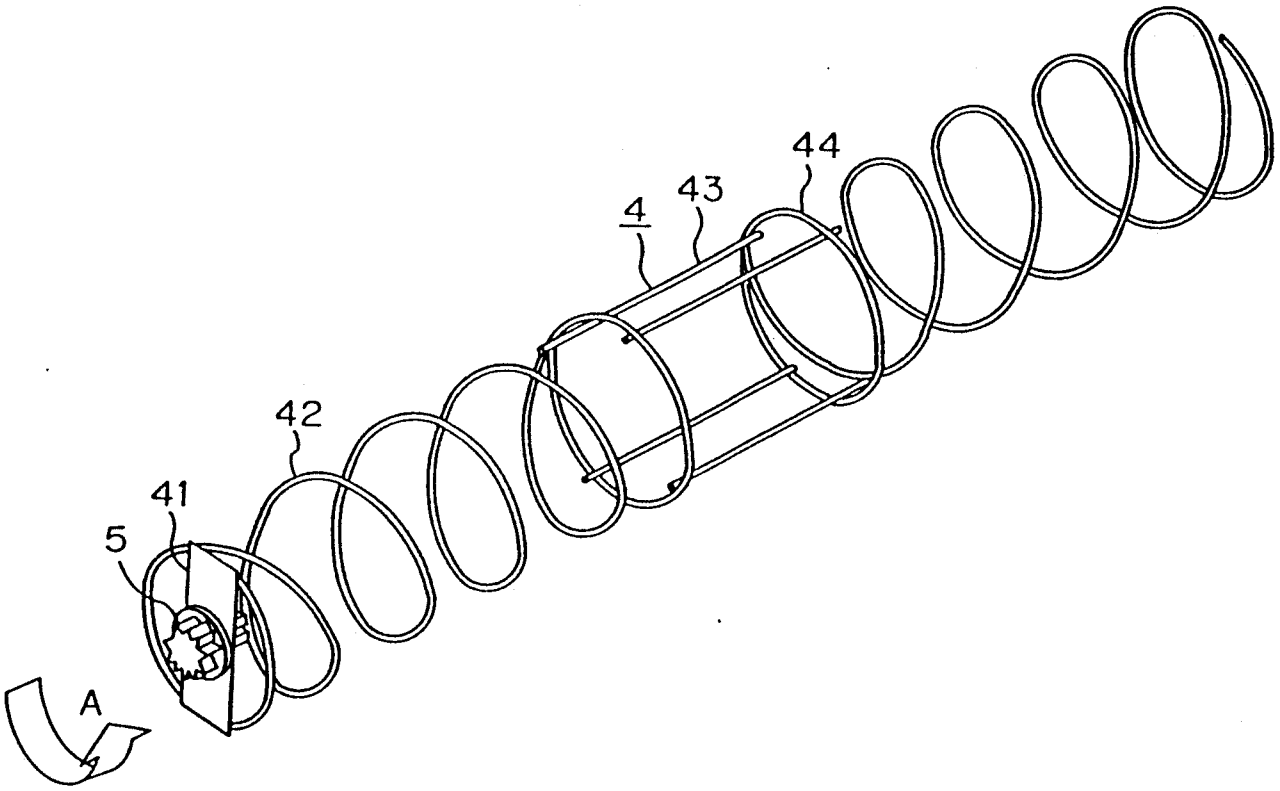
FIG. 2 is a perspective view showing the arrangement of a stirring means.

The arrangement of the stirring member 4 is illustrated in FIG. 2. The stirring member 4 comprises the end member 41, a spiral portion 42, a central portion 43 and a spiral portion 44. According to the prevent invention, the end member 41 is a rectangular metal plate, and the spiral portion 2, the central portion 43 and the spiral portion 44 are respectively formed of piano wire. The end member is fixed to the spiral portion 42, the spiral portion 42 is fixed to the central portion 43, and the central portion 43 is fixed to the spiral portion 44 respectively by silver braizing or soldering. The piano wire of the spiral portion 42 is spiraled in the opposite direction to the spiral portion 44 as is evident in FIG. 2. Accordingly, if the stirring member 4 rotates in the direction of the arrow A in FIG. 2, the toner, not shown collects about the central portion 43 inside the toner cartridge 100. The result is that a sufficient amount of the toner can be always supplied to the central portion of the printing paper where much toner is used.

The gear 5 is fixed to the end member 41. The gear has a central axis, not shown, which is common to the axis of the spiral portions 42 and 44.

Figure 3:
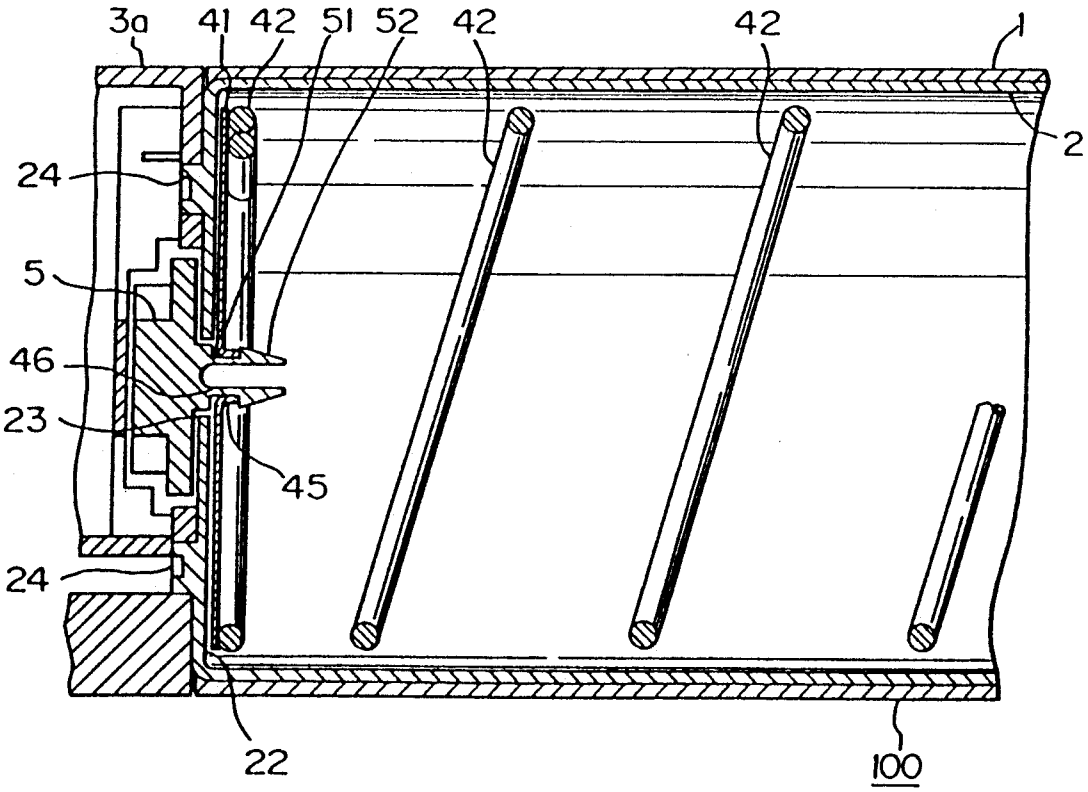
FIG. 3 is a cross sectional view taken along the longitudinal direction of the toner cartridge.

FIG. 3 is a cross sectional view taken in the longitudinal direction of the toner cartridge 100 at the portion adjacent to the end plate 3*a*. In the same figure, designated at 51 is a projection integrated with the gear 5, 52 is a pawl provided at the top end of the projection 51,22 is an end surface of the inner cylinder 2, 23 is a round hole defined at the center of the end surface 22, 24 are projections protruding from the end surface 22, 45 is a cut protrusion provided at the end member 41 and 46 is a square hole provided at the member 41.

The projection 51 has a central axis, not shown, which is common to the axes of the gear 5 and the spiral portion 42. The projection 51 penetrates the round hole 23 and is rotatably supported by the inner cylinder 2. The pawl 52 of the axis 51 penetrates the square hole 46 and meshes with the cut protrusion 45.

Accordingly;, the pawl 52 presses the end member 41 so that the end member 41 is not moved away from the end surface 22. As a result, the gear 5 and the end member 41 clamp the end surface 22, whereby the gear 5 and the stirring member 4 are restricted to move in the direction of the central axes thereof.

The pawl 52 has a root touching internally with the square hole 46 in cross section. Hence, the end member 41 is driven by the gear 5 and capable of rotating.

Described hereinafter are a mechanism for attaching the toner cartridge 100 to or detaching the same cartridge 100 from a photosensitive drum, described later, and a mechanism for driving the stirring member 4.

Figure 4:
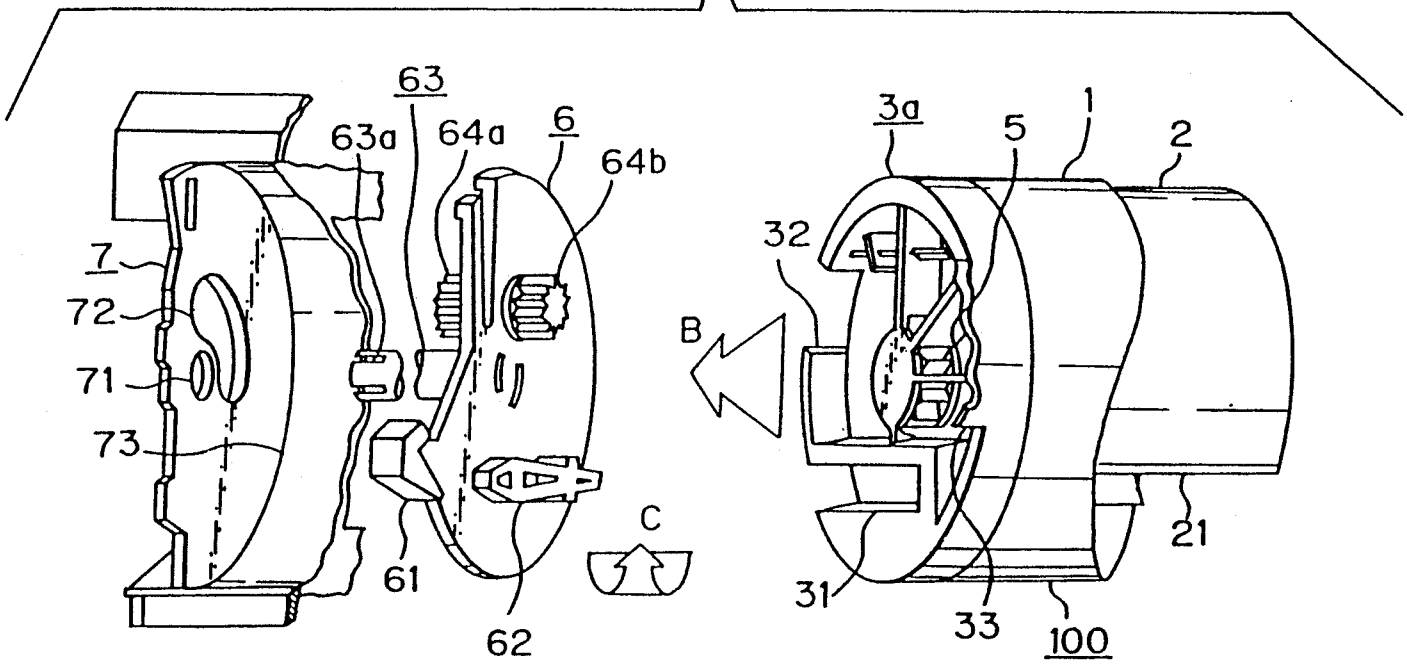
FIG. 4 is an exploded perspective view illustrating a mechanism for fixing the toner cartridge.

FIG. 4 is a schematic view explaining the mechanism for fixing the toner cartridge 100 to the photosensitive drum cartridge. In the same figure, designated at 31 is a groove defined in the end plate 3*a*, 32 is a notched portion defined at a part of the periphery of the end plate 3*a*, and 33 is a pawl defined at a part of the periphery of the end plate 3*a*. Designated at 6 is a fixing member, 61 is a knob integrated with the fixing member 6, 62 is a guide integrated with the fixing member 6, 63 is a shaft integrated with the fixing member 6, 63*a* is a pawl provided at the tip end of the axis 63 and 64*a* and 64*b* are gears integrated with each other and rotatably supported by a shaft which penetrates the fixing member 6, not shown. The shaft supporting these gears 64*a* and 64*b* will be described later by illustration.

Designated at 7 is a toner cartridge holder integrate with the photosensitive drum cartridge. The toner cartridge holder 7 has a round hole 71 and an arcuate slot 72. The toner cartridge holder 7 has also a recess 73 having a semi circular shape in cross section.

With such a mechanism, the shaft 63 is inserted into the round hole 71 and is rotatable relative to the toner cartridge holder 7 and supported by a mechanisms, which will be described later, so as not to come out from the round hole 71. The gear 64*a* is inserted into slot 72 and movable in slot 72 as the fixing member 6 rotates.

If the end plate 3*a* is moved along the fixing member 6 and the toner cartridge 100 is inserted into the recess 73 in the direction of the arrow B, i.e. in the direction from the plane of the drawing to the back thereof, the position of the end plate 3*a* is restricted by the toner cartridge holder 7 so that the gear 64*b* passes through the notched portion 32 and meshes with the gear 5. At the same time, the guide 62, which is positioned parallel to the direction of the arrow B, enters the groove 31. When the toner cartridge 100 is fixed to the printer, the fixing member 6 is turned by 90 degrees in the direction of the arrow C. The knob 61 is brought into contact with the pawl 33 to thereby drive and turn the end plate 3*a*. At this time, since the end plate 3*a* is engaged with the fixing member 6 by way of the groove 31 and the guide 62, the end plate 3*a* becomes perpendicular relative to the direction of the arrow B together with the guide 62 and the groove 31 when the fixing member 6 is turned. Since the outer cartridge 100 is restricted to move in the direction of the arrow B and the direction perpendicular to the direction of the arrow B by the toner cartridge holder 7, it cannot be come out from the toner cartridge holder 7. If the same mechanism is provided at the end plate 3*b*, the toner cartridge 100 can be fixed to the toner cartridge holder 7. In this case, it is evident that the end plate 3*b* can dispense with the slot 71, the gears 64*a* and 64*b*, and the notched portion 32.

Figure 5:
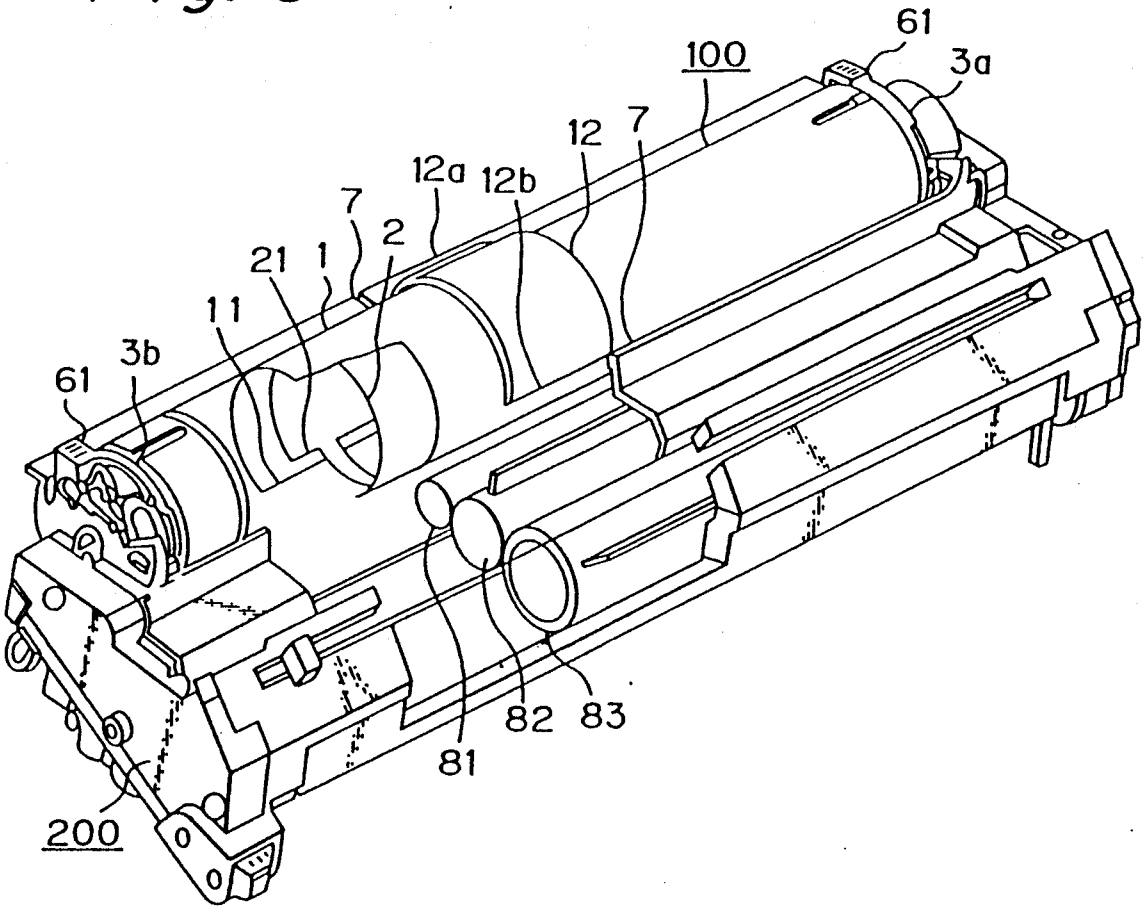
FIG. 5 is a perspective view showing the state where the toner cartridge is mounted on an electrophotographic printer.

FIG. 5 is a perspective view showing the state where the toner cartridge 100 is mounted on a photosensitive drum cartridge 200.

In the same figure, designated at 81 is a toner supply roller formed of sponge and disposed substantially under the toner cartridge 100, 82 is a developing roller formed of rubber and provided in contact with the toner supply roller 81 and 83 is a photosensitive drum provided in contact with the developing roller 82 and having an optical conductive layer at the surface thereof.

The photosensitive drum cartridge 200 is formed by incorporating these components with the toner cartridge holder 7.

Designated at 12 is a restriction member fixed to the peripheral surface of the outer cylinder 1 and has ends thereof 12*a* and 12*b*.

If the toner cartridge 100 is inserted into the toner cartridge holder 7 and the pair of fixing members 6 are turned by the operation of the pair of knobs 61, the end plates 3*a* and 3*b* engaged with each fixing member 6 ar turned. At this time, the inner cylinder 2 fixed to the end plates 3*a* and 3*b* at both ends thereof is also turned. The outer cylinder 1 cannot be substantially turned since the one end 12*a* of the restriction member 12 is brought into contact with the toner cartridge holder 7 to restrict the turning of the outer cylinder 1. Accordingly, the opening 21 of the inner cylinder 2 is turned and aligned with the opening 11 of the outer cylinder 1, which is not turned.

When two openings 11 and 21 are aligned the toner is supplied to the surface of the toner supply roller 81. The toner is then transferred to the surface of the photosensitive drum 83 by the developing roller 82 and is selectively attracted to an electrostatic image formed on the optical conductive layer so as to form a toner image which is transferable to the printing paper.

When the knobs 61 are operated in the opposite direction so as to remove the toner cartridge 100 from the toner cartridge holder 7, the fixing members 6, the end plates 3*a* and 3*b*, and the inner cylinder 2 are also turned in the opposite direction. The outer cylinder 1 is prevented from turning since the other end 12*b* of the restriction member 12 is brought into contact with the toner cartridge holder 7. Accordingly, the opening 21 is moved away from the opening 11 so that the inner cylinder 2 closes the opening 11, thereby closing the toner cartridge 100.

When the toner cartridge 100 is fixed to the toner cartridge holder 7, it sometimes happens that the knob 61 cannot be smoothly turned because of misalignment between one fixing member 6 and the end plate 3*a* or between the other fixing member 6 and the end plate 3*b*, and the resulting shallow meshing between the gear 64*b* and the gear 5. This is caused by the fact that the tooth tip and the tooth root of the gear 64*b* are not precisely opposed with, but instead deviate from, those of the gear 5.

In such a case, if the toner cartridge 100 is pushed into the toner cartridge holder 7 while the knob 61 of the fixing member 6 having the gear 69*b* is swung little by little, the axes of the fixing member 6 and the end plate 3*a* or the axes of the other fixing member 6 and the end plate 3*b* become well aligned with each other so that the knob 61 can be smoothly moved.

Figure 6:
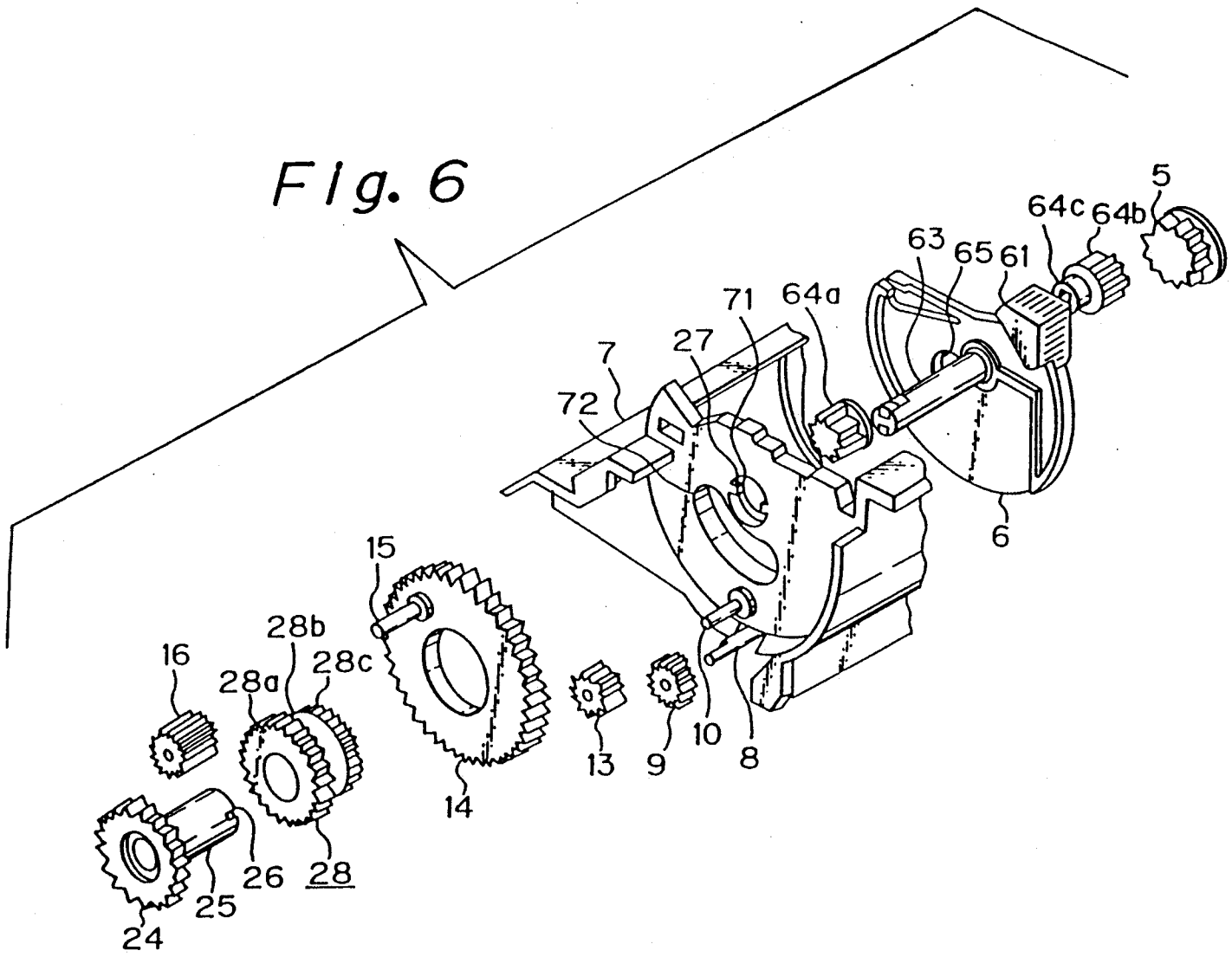
FIG. 6 is an exploded perspective view of a drive force transmission mechanism.

FIG. 6 is an exploded perspective view showing the drive force transmission mechanism of the embodiment of the present invention. In the same figure, designated at 8 is a drive shaft rotatably driven by a drive unit, not shown, 9 is a drive gear rotatable together with the drive shaft, 10 is a fixed post to the toner cartridge holder 7, 13 is an idle gear rotatably supported by the fixed post 10, 14 is a ring gear, 15 is a movable post provided at the ring gear 14, 16 is a planetary gear rotatably supported by the movable post 15, 24 is a fixed gear, 25 is a tube integrated with the fixed gear 24, 26 is a key groove defined at the tip end of the tube 25 at the opposite side of the fixed gear 24, 27 is a key defined in a round hole 71, 28 is a driven gear, 64*c* is a shaft integrally mounted on a gear 64*b* and 65 is a round hole defined in the fixing member 6.

The driven gear 28 is inserted into the ring gear 14. The tube 25 is inserted into the driven gear 28. The tube 25 is fixed to the toner cartridge holder 7.

That is, the key groove 26 and the key 27 are engaged with each other whereby the tube 25 and the fixed gear 24 integrated with the tube 25 can not rotate. However, the driven gear 28 and the ring gear 14 can freely rotate.

The shaft 63 is inserted into the tube 25. As a result the tube 25, the fixed gear 24, the shaft 63, the driven gear 28 and the ring gear 14 are held by the toner cartridge holder 7. These elements can independently rotate except the tube 25 and the fixed gear 24.

The shaft 64*c* integrated with gear 64*b* is inserted through the hole 65 in fixing member 6. The shaft 64*c* is fixed to the gear 64*a*. Accordingly, both the gears 64*a* and 64*b* are integrally rotatable.

A drive force applied to the drive shaft 8 by a drive unit, not shown, is transmitted to the drive gear 9, the idle gear 13 and the ring gear 14 in this order to thereby rotate the movable post 15. At this time, since the planetary gear 16 meshes with the fixed gear 24, the planetary gear rotates around the fixed gear 24 while also rotating on its own axis. The planetary gear 16 also meshes with the driven gear 28. The driven gear comprises a large diameter portion 28*a*, an annular portion 28*b* and a small diameter portion 28*c*. The large diameter portion 28*a* meshes with the planetary gear 16 and has a high pitch diameter substantially the same as that of the fixed gear 24 and teeth which are different from those of the fixed gear 24 in number.

With such an arrangement, the fixed gear 24, the planetary gear 16 and the large diameter portion 28*a* constitute a kind of planetary gear mechanism wherein the driven gear 28 rotates at low speed accompanied by the rotation of the planetary gear 16. The direction of the rotation of the planetary gear 16, i.e. the direction of rotation of the ring gear 14 and the direction of rotation of the driven gear 28, coincide with each other if the large diameter portion 28*a* has more teeth than the fixed gear 24. If when the large diameter portion 28*a* has less teeth than the fixed gear 24, the direction of rotation of the ring gear 14 is contrary to that of the driven gear 28.

According to this embodiment, it may be arbitrarily determined which of the fixed gear 24 and the large diameter portion 28*a* should have more teeth than the other considering the desirable directions of rotation of the shaft 8 and the gear 5. FIG. 6 shows the state wherein the large diameter portion 28*a* has more teeth than the fixed gear 24. However, the difference in the number of teeth between the fixed gear 24 and the large diameter portion 28*a* is preferable to be preferably small in order to rotate the driven gear 28 smoothly.

When the driven gear 28 is rotated in the manner as described above, the drive force of rotation is transmitted by way of the gears meshing with each other in the order of the small diameter portion 28c, the gear 64a piercing the slot 72, the shaft 64c and the gear 64b, whereby the gear 5 which meshes with the gear 64b is rotated.

Even in the fixing member 6 is turned on the shaft 63, the arrangement is such that the gears are kept to mesh with each other, so that the drive force is unchangeably transmitted.

This is caused by the fact that the gears 64a and 64b can swing about the axis of shaft 63, while the driven gear 28 and the gear 5 meshing with the gear 64b, have the same axis as the shaft 63. That is, when the fixing member 6 is turned, the gear 64a is swung around the periphery of the driven gear 28 while the gear 64b is swung round the periphery of the gear 5 respectively meshing with each other.

With such an arrangement of the drive mechanism, many gears have a common axis. The driven gear 28 is inserted into the ring gear 14 and the tube 25 is inserted into the driven gear 28, and the gears are arranged on both sides of the ring gear 14 so that it is possible to construct a drive mechanism making an effective use of a small space.

The fixed gear 24 and the driven gear 28 have different angles of rotation per tooth, i.e., the values obtained by dividing 360 degrees by the number of teeth. Since each of the angles of rotation per tooth corresponds to that of the planetary gear, a relative motion is generated between the fixed gear 24 and the driven gear 28 accompanied by the rotation of the planetary gear 16. The drive force transmission mechanism set forth above makes use of the relative motion as the drive force. As a result, a great sped reduction ratio can be easily obtained with the arrangement of the fixed gear 24 and the driven gear 28 having large numbers of teeth respectively but a little difference therebetween. It results in the advantage that the drive force can be obtained from the photosensitive drum for rotating the drive shaft 8 without applying a large load to the drive mechanism of the photosensitive drum, or the stirring member 4 can be driven with a large torque. The drive mechanism may be constructed so as to directly drive the ring gear 14 or the driven gear 28 by a motor exclusively provided for stirring the toner.

The photosensitive drum cartridge 200 loaded with the toner cartridge 100 in this way is mounted on the electrophotographic printer as described later.

Figure 7:
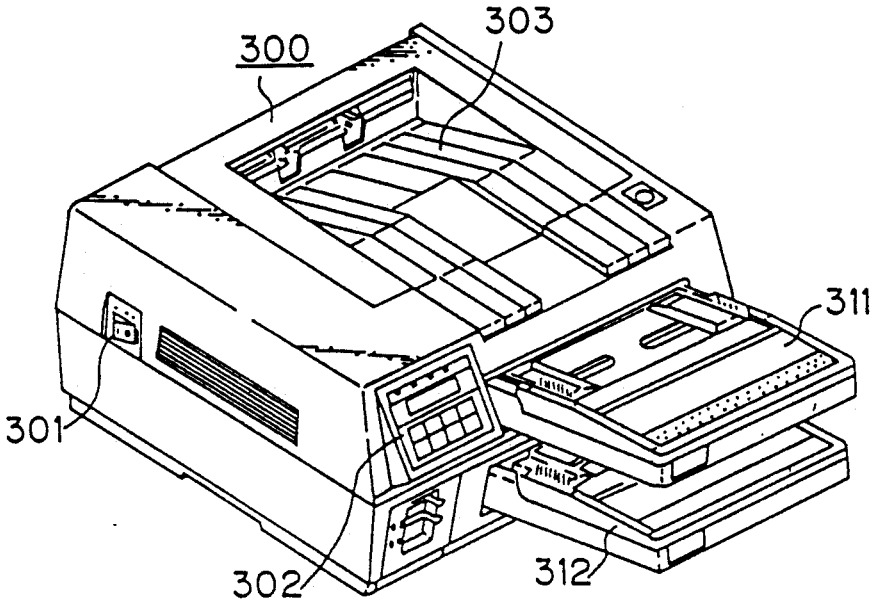
FIG. 7 is a perspective view showing the external appearance of the electrophotographic printer and FIG. 8 is a schematic side view employed to explain the printing process of the electrophotographic printer.
Figure 8:
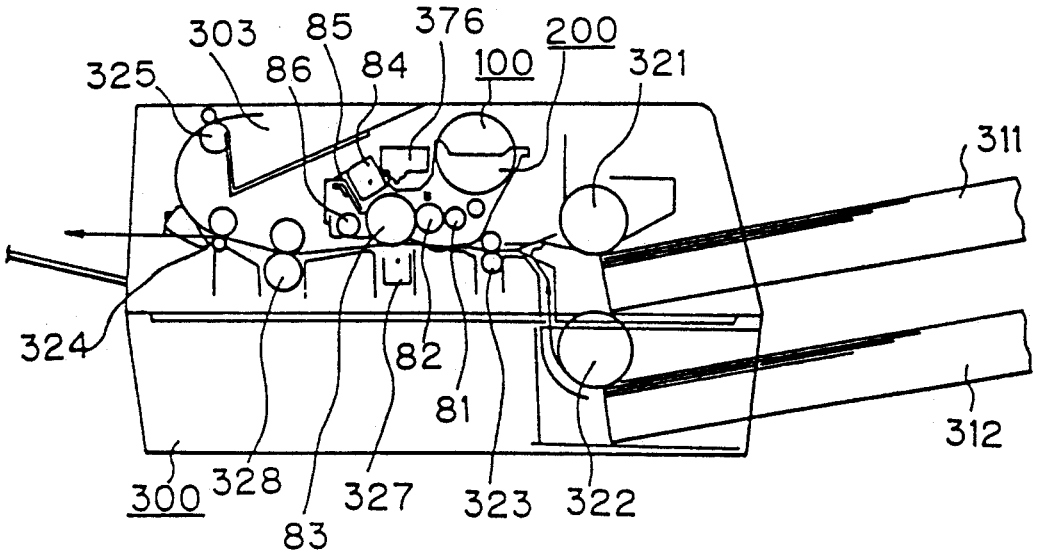

FIG. 7 is a perspective external view of the electrophotographic printer and FIG. 8 is a view employed for explaining the printing process of the electrophotographic printer.

In the same figures, designated at 300 is an electrophotographic printer, having a power switch 301 for starting the electrophotographic printer 300, an operation panel 302 indicating the setting of the printing condition and the error condition of the electrophotographic printer 300, and a stacker portion 303 to which the printed sheets are fed. Designated at 311 and 312 are printing sheet cassettes in which the printing sheets are stacked. The cassettes are detachable from the electrophotographic printer 300.

The electrophotographic printer 300 has therein feed rollers 321 and 322 for feeding the printing sheets stacked in the printing sheet cassettes 311 and 312, a pair of rollers 323 for conveying a printing sheet fed from the printing sheet cassettes 311 or 312, an LED array 376 for emitting light to the photosensitive drum 83 for thereby forming an electrostatic latent image on the photosensitive drum 83, a transfer electrostatic charger 327 for transferring toner from the photosensitive drum 83 to the printing sheet, a pair of heat rollers 328 for fixing the toner transferred on the printing sheet and a photosensitive drum cartridge 200.

The photosensitive drum cartridge 200 has an electrostatic charger 84 for electrostatically charging the photosensitive drum 83 uniformly, an electrostatic electricity eliminating light source 85 for uniformly eliminating the electrostatic charge on the photosensitive drum 83 and a cleaner 86 for eliminating the toner on the photosensitive drum 83 as well as the toner supply roller 81, the developing roller 82, and the photosensitive drum 83.

The printing process of the electrophotographic printer will be described hereinafter.

The printing sheet fed from the printing sheet cassette 311 or 312 by the feed roller 321 or 322 is conveyed to the photosensitive drum 83 by way of the rollers 322.

The photosensitive drum 83 is rotated by a drive source, not shown, and is uniformly electrostatically charged by the electrostatic charger 84. An electrostatic latent image is formed on the surface of drum 83 by the LED array 376. The electrostatic latent image on the surface of the photosensitive drum 83 can be visually imaged by toner transferred by the toner supply roller 82. This toner image is transferred to the printing sheet by the transfer electrostatic charger 327.

Thereafter, the static electricity on the surface of the photosensitive drum 83 is uniformly electrostatically eliminated and the toner remaining on the surface of the photosensitive drum 83 is cleaned by the cleaner 85, which is brought into contact with the photosensitive drum 83. Thereafter, the next image forming process follows.

Since the drive force is applied to the drive shaft 8 accompanied by the rotation of the photosensitive drum 83, the stirring member 4 in the toner cartridge 100 is also rotated, thereby stirring the toner uniformly.

The image transferred to the printing sheet is fixed on the printing sheet by the heat rollers 328. The printing sheet is then fed forward by roller pairs 324 and 325 to the stacker portion 303. Alternatively, the printing sheet may be discharged from the electrophotographic printer 300 after passing the roller pairs 324.

With the arrangement set forth above, when the toner cartridge 100 is inserted into the toner cartridge holder 7, grooves 31 in the end plates 3a and 3b of the toner cartridge 100 are engaged by guides 32 provided on the fixing members 6. At the same time the gear 64b is engaged with the gear 5. When the knobs 61 are operated to rotate the fixing member 6, both end plates 3a and 3b rotate. As a result, both end plates 3a and 3b are respectively fixed by the guides 32, whereby the whole of the toner cartridge 100 is fixed to the toner cartridge holder. At the same time, the gear 64a meshes with and rotates round the driven gear 28 and the gear 64b meshes with and rotates around the gear 5. Furthermore the inner cylinder 2 rotates, being fixed to the end plates 3a and 3b but the outer cylinder 1 is immobilized by the restriction member 12. Consequently, the opening 11 defined on the outer periphery of the outer cylinder 1 and the opening 21 on the outer periphery of the inner cylinder 2 overlap with each other at the lower portion of the toner cartridge 100 so that the toner cartridge 100 is open downward, whereby the toner can be supplied toward the electrophotographic printer.

At this point if a drive force is applied to the drive shaft 8, the drive force can be transmitted to the ring gear 14 through the drive gear 9 and the idle gear 13, thereby rotating the planetary gear 16. The planetary gear 16 rotates while it meshes with two gears having different numbers of teeth, i.e. The fixed gear 24 and the large diameter portion 28*a* of the driven gear 28, whereby relative motion between the fixed gear 24 and the large diameter portion 28*a* is generated. With this relative motion, the gear 5 of toner cartridge holder 7 is rotated via small diameter portion 28*c*, gear 64*a*, and gear 64*b*, thereby generating the drive force which is transmitted to the stirring member 4.

Since the stirring member 4 touches the internal wall of the substantially cylindrical inner cylinder 2 and has filament members disposed in parallel with the rotary axis of the inner cylinder 2 at the central portion thereof and spiral filament members at both ends thereof, the mass of the toner can be scraped away from the internal wall of the inner cylinder 2 at substantially all positions thereof.

Accordingly, the mass of the toner can be prevented from sticking to the inner wall of the inner cylinder 2 of the toner cartridge 100, and the toner is sufficiently stirred and supplied to the electrophotographic printer.

A scope of the present invention is not limited to the embodiment set forth above and can be variously modified without departing therefrom. The embodiment set forth above does not exclude modified embodiments from the scope of the present invention.

The toner container according to the present invention is adapted for electrophotographic printers employing the LEDs, laser beams and the like as the light source for forming the electrostatic latent image, and for electrophotographic printers with high printing accuracy, small size and low cost.

We claim:

1. A toner cartridge to be mounted on a photosensitive drum cartridge which is loaded in an electrophotographic printer, comprising:

a hollow cylindrical container to accommodate a toner employed by the electrophotographic printer, the container having first and second ends and having a curved wall between the ends, the curved wall having a first elongated opening for discharge of toner adjacent the first end of the container, a second elongated opening for discharge of toner adjacent the second end of the container, and a central elongated opening for discharge of toner between the first and second openings, the curved wall additionally having an interior surface;

a filamentary stirring member rotatably disposed in the container and touching the interior surface of the curved wall, the stirring member having first and second spiral portions which spiral in opposite directions from each other and a central portion having a linear shape disposed between the first and second spiral portions; and means mounted on the container for rotating the stirring member from outside the container so that the stirring member sweeps substantially the entire interior surface of the curved wall.

2. A toner cartridge according to claim 1, wherein the filamentary stirring member comprises steel wire.

3. A toner cartridge of claim 1, wherein the container comprises a pair of hollow cylinders, one being rotatably disposed in the other.

4. A toner cartridge of claim 3, wherein each cylinder has at least one window, the openings in the container being provided by alignment of the at least one window in one of the cylinders with the at least open window in the other of the cylinders, the openings in the container being closable by rotating one cylinder with respect to the other.

5. An electrophotographic printer having a photosensitive drum cartridge detachably loaded therein for receiving a toner, the photosensitive drum cartridge mounting a toner cartridge, characterized in that:

the toner cartridge includes a hollow cylindrical container to accommodate the toner, the container having first and second ends and having a curved wall between the ends, the curved wall having a first elongated opening for discharge of toner adjacent the first end of the container, a second elongated opening for discharge of toner adjacent the second end of the container, and a central elongated opening for discharge of toner between the first and second openings, the curved wall additionally having an interior surface;

a filamentary stirring member rotatably disposed in the container and touching the interior surface of the curved wall, the stirring member having first and second spiral portions which spiral in opposite directions from each other and a central portion having a linear shape between the first and second spiral portions;

means mounted on the container for rotating the stirring member from outside the container so that the stirring member sweeps substantially the entire interior surface of the curved wall, the first and second spiral portions urging toner toward the central portion of the stirring member as the stirring member rotates; and end plate means mounted at the ends of the container for engaging with the photosensitive drum cartridge; and the photosensitive drum cartridge includes means for releasably engaging the end plate means of the toner cartridge;

a shaft;

drive means for rotating the shaft; and drive force transmission means for transmitting a drive force from the shaft to the means mounted on the container for rotating the stirring member from outside the container, the drive force transmission means including a planetary gear mechanism and a gear train linking the planetary gear mechanism to the shaft, the planetary gear mechanism including two coaxially mounted gears and a planetary gear which meshes with the coaxially mounted gears.

6. The electrophotographic printer of claim 5, wherein the container comprises a pair of hollow cylinders, one being rotatably disposed in the other.

7. The electrophotographic printer of claim 6, wherein each cylinder has at least one window, the openings in the container being provided by alignment of the at least one window in one of the cylinders with the at least one window in the other of the cylinders, the openings in the container being closable by rotating one cylinder with respect to the other.

8. The electrophotographic printer of claim 7, wherein the means for releasably engaging the end plate means further comprises means for rotating one cylinder with respect to the other.

* * * * *